United States Patent [19]

Metzger

[11] 4,448,469

[45] May 15, 1984

[54] BATTERY SECURING DEVICE

[76] Inventor: Romain Metzger, 408 Pleasant Run Dr., Wheeling, Ill. 60090

[21] Appl. No.: 380,138

[22] Filed: May 20, 1982

[51] Int. Cl.[3] ..... H01R 13/639

[52] U.S. Cl. ..... 339/82; 339/224

[58] Field of Search ..... 339/37, 82, 116 R, 116 C, 339/224

[56] References Cited

U.S. PATENT DOCUMENTS 1,762,203 6/1930 Teipel ..... 339/82

3,535,899 10/1970 Gardner et al. ..... 339/37

*Primary Examiner*—John McQuade

*Attorney, Agent, or Firm*—Richard W. Carpenter

[57] ABSTRACT

A device for preventing the removal of a battery, from a vehicle or other location, which comprises a pair of interlocking members adapted to be secured to a battery terminal post and cable and to each other, respectively, by a padlock.

6 Claims, 6 Drawing Figures

BATTERY SECURING DEVICE

BACKGROUND OF THE INVENTION

1. Field of the Invention

This invention relates to battery securing devices, and more particularly to a device which may be attached to a battery, of the type used in motor vehicles, and secured with a padlock to prevent a theft of the battery.

2. Description of the Prior Art

A prior art search in the U.S. Patent and Trademark Office directed to the subject matter of this invention disclosed the following U.S. Letters Patent: Nos.

1,328,109
1,527,625
1,558,491
1,570,722
1,583,609
1,654,450
1,762,203
3,181,523
3,284,121
3,290,458
3,494,400
3,535,899
3,633,154
3,641,480

None of the prior art found disclosed a two-piece lock bar and cover arrangement for securing a vehicle battery with a padlock in the manner of Applicant's invention.

SUMMARY OF THE INVENTION

It is an object of the invention to provide a relatively simple device which may easily be attached to a battery, of the type used in motor vehicles, to prevent a theft of the battery.

Another object of the invention is to provide a battery securing device which will permit the battery to be readily covered and locked in place with a conventional padlock.

A more specific object of the invention is the provision of a battery securing device including a pair of members adapted to be secured to a battery terminal post and cable and to each other by a padlock.

These and other objects of the invention will be apparent from an examination of the following description and drawings.

It will be understood that for purposes of clarity, certain elements may have been intentionally omitted from certain views where they are believed to be illustrated to better advantage in other views.

DESCRIPTION OF THE PREFERRED EMBODIMENT

Figure 5:
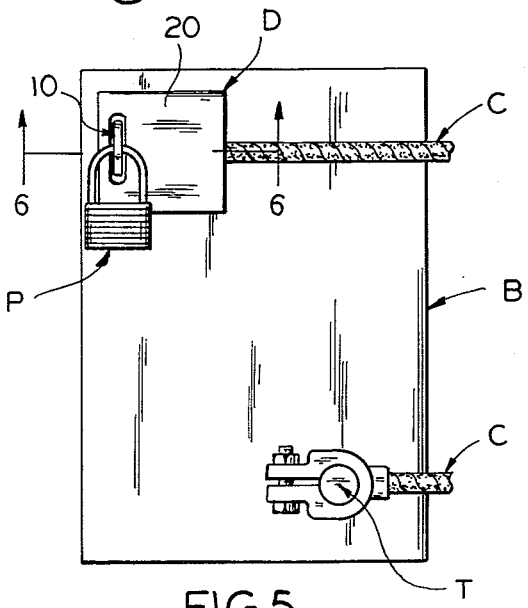
FIG. 5 is a fragmentary top plan view of the battery and securing device illustrated in FIG. 4.

Referring now to the drawings for a better understanding of the invention, and particularly to FIG. 5, it will be seen that the novel battery securing device, indicated generally at D is adapted for use in securing a vehicle type battery B, having a terminal post T and cable C, with a padlock P.

Figure 1:
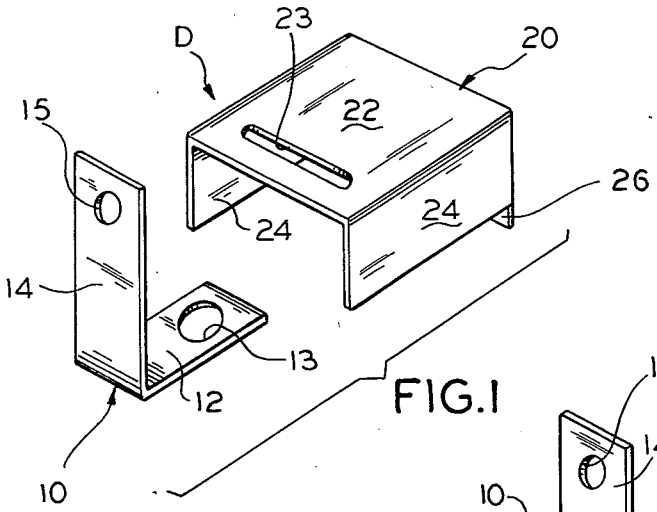
FIG. 1 is an exploded perspective view of the two components of a battery securing device embodying features of the invention.
Figure 2:
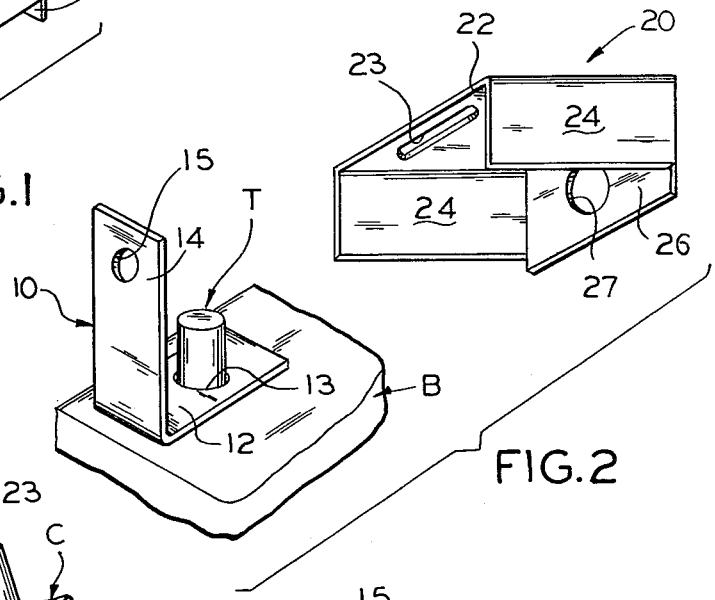
FIG. 2 is view similar to that of FIG. 1, but illustrating the attachment of one component to a battery terminal.

As best seen in FIG. 1, the novel battery securing device of the invention includes a pair of locking and cover members 10, and 20, respectively.

Locking or inner member 10 is preferably L-shaped and has a pair of integral arms which are angularly related to each other.

First arm 12 is provided, adjacent a free end thereof, with an opening 13 for receiving a battery terminal post T in a manner hereinafter described.

Second arm 14 is disposed at an angle to first arm 12 and is provided with an opening 15 for receiving the loop of a padlock as hereinafter described.

Cover or outer member 20 is a box-like structure with a top panel 22 having extending through the forward end thereof an opening 23 for receiving a portion of locking member second arm 14.

Cover member also has a pair of integral side panels 24 extending downwardly from the side edges thereto and a rear panel 26 extending downwardly from the rear edge thereof between side panels 24. Rear panel 26 is provided with an opening 27 extending therethrough for receipt of a battery cable C as hereinafter described.

In order to use the novel device for securing a battery B, the cable C, connecting one of the terminal parts to a vehicle motor or other device, is removed and passed through opening 27 in rear wall 26 of cover member 20.

Locking member 10 is then attached to the battery B by passing the battery terminal post T through opening 13 in first arm 12 of locking member 10. The cable C is then secured to the terminal post T by a clamp in the usual manner.

Figure 3:
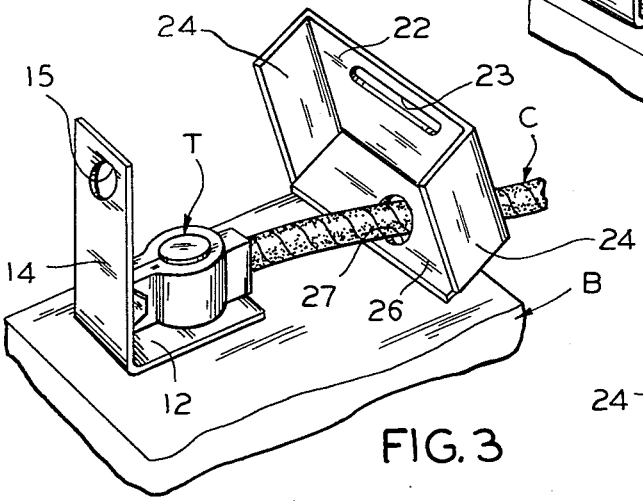
FIG. 3 is a view similar to that of FIG. 2, but illustrating the attachment of the other component to a battery cable.
Figure 4:
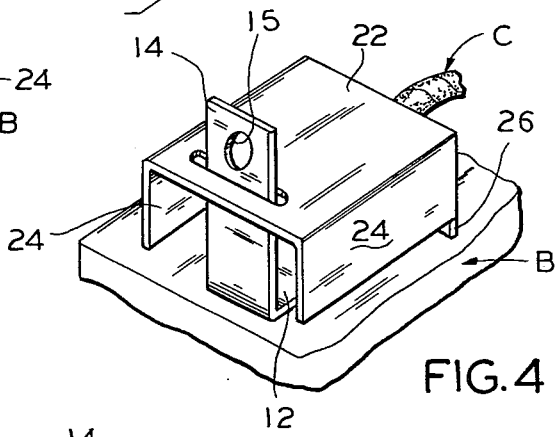
FIG. 4 is a view similar to that of FIG. 3, but illustrating the relation of and means of attachment of the components to each other.
Figure 6:
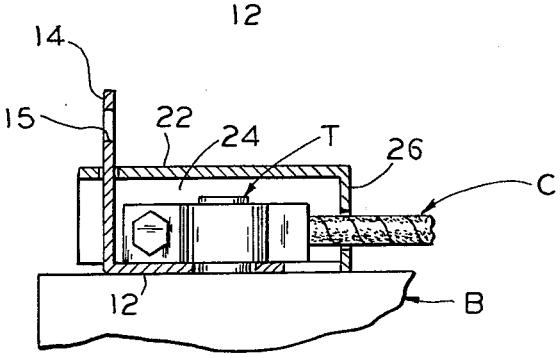
FIG. 6 is a fragmentary vertical section taken on line 6—6 of FIG. 5.

At this point the components of the securing device are approximately in the positions illustrated in FIG. 3. Cover member 20 is then moved forward to the position shown in FIGS. 4–6, with the free end of second arm 14 of locking member 12 extending upward through opening 23 in cover member top panel 22.

A padlock P may then be passed through opening 15 in locking member second arm 14 to prevent the arm from being passed through opening 23 in cover member top panel 22.

When this has been completed, as illustrated in FIG. 5, it is virtually impossible to remove the battery B from a vehicle or other location without cutting the battery cable C or destroying the padlock P.

While it may be impossible to absolutely prevent the theft of a battery from a vehicle, the present invention makes it extremely difficult for someone to remove a battery quickly or easily if it has been protected with the securing device of the present invention.

What is claimed is:

1. A device for preventing the theft of a battery from a vehicle or other location by eliminating access to a connection between a cable and a terminal post of the battery, said device comprising:

(a) a generally L-shaped locking member having a pair of angularly related arms;

(i) one of said arms being adapted to extend into a related cover member and be secured to a battery terminal post under the end of a battery cable which is also attached to said battery terminal post;

(ii) the other of said arms being adapted to be connected to said cover member by a padlock;

(iii) said arms containing separate openings for attachment to said battery terminal post said padlock, respectively (b) a cover member adapted to shroud a connection between a battery terminal post, a cable, and said locking member and having:

(i) a first opening for receiving a portion of said battery cable;

(ii) a second opening for receiving said one arm of said locking member.

2. A device according to claim 1, wherein said cover member includes:

(a) a first panel having an opening for receiving a battery cable;

(b) a second panel extending from said first panel and adapted to cover a battery terminal post and a connection between said post, cable, and locking member one arm;

(c) said second panel having an opening for receiving said locking member other arm.

3. A device according to claim 1, wherein said cover member is a box-like structure including:

(a) a top panel covering said battery terminal post cable, and locking member one arm and having an opening extending therethrough for receipt of said locking member other arm;

(b) a pair of side panels depending from opposed side edges of said top panel;

(c) a rear panel extending from a rear edge of said top panel between said side panels and having an opening extending therethrough for receipt of said cable.

4. A device for preventing the theft of a battery from a vehicle or other location by eliminating access to a connection between a battery cable and a terminal post of the battery, said device comprising a pair of locking and cover members receiving a battery terminal post and battery cable, respectively, and interlockingly connected to each other with at least one of said members having means for receiving a portion of a padlock to prevent the separation of the members from each other, said locking member being a bar type structure having a pair of openings spaced from each other for attachment to said battery terminal post and said padlock, respectively.

5. A device according to claim 4, wherein said cover member is a hollow, box-like structure having a pair of openings therein spaced from each other adjacent opposite ends thereof.

6. A device according to claim 4, wherein said cover member is a hollow box-like structure including a horizontal top panel having a plurality of vertical panels depending from side edges thereof.

* * * * *